US005548300A

United States Patent [19]

Tokimoto

[11] Patent Number: 5,548,300

[45] Date of Patent: Aug. 20, 1996

[54] MANUAL ROTATION TYPE DISPLAY DEVICE

[75] Inventor: Toyotaro Tokimoto, Yokohama, Japan

[73] Assignee: Avix Inc., Yokohama, Japan

[21] Appl. No.: 359,363

[22] Filed: Dec. 20, 1994

[51] Int. Cl.[6] ..... G09G 3/14

[52] U.S. Cl. ..... 345/39; 340/815.45; 345/46

[58] Field of Search ..... 345/39, 46; 340/815.45

[56] References Cited

U.S. PATENT DOCUMENTS 5,406,300 4/1995 Tokimoto ..... 345/39

FOREIGN PATENT DOCUMENTS 3-50541 10/1991 Japan .

2116297 9/1983 United Kingdom ..... 340/815.45

*Primary Examiner*—Richard Hjerpe

*Assistant Examiner*—Vui T. Tran

*Attorney, Agent, or Firm*—Pennie & Edmonds

[57] ABSTRACT

A manually operated rotary type display device comprises a device body of an elongated bar-shaped configuration having a plurality of light emitting cells provided on the surface of the device body and arranged in alignment along a longitudinal direction thereof to form a light emitting cell array, an operation fulcrum member mounted on one end of the device body and rotatable about an axis perpendicular to the longitudinal direction of the device body, a rotary marker secured to the operation fulcrum member for co-rotation therewith and having at least one mark, rotation detecting means for obtaining a relative angular position information between the device body and the operation fulcrum member and rotation speed information by detecting the mark of the rotary marker, storage means for storing an image data to be displayed by rotational scanning of the light emitting cell array, and display control means for reading out the image data sequentially from the storage means in synchronism with a detection signal by the rotation detecting means.

9 Claims, 7 Drawing Sheets

MANUAL ROTATION TYPE DISPLAY DEVICE

BACKGROUND OF THE INVENTION

1. Field of the Invention

The present invention relates to a manual rotation type display device for aerially displaying an image utilizing a residual image effect by rotating the display device about a finger of a user's hand.

2. Description of the Related Art

Japanese Unexamined Utility Model Publication (Kokai) No. Heisei 3-50541 discloses a rotary scan type aerial display device. In the disclosed construction, the display device is mounted on a rotary body, such as a wheel of a bicycle. With respect to the center of rotation, a plurality of light emitting elements are arranged in alignment in the radial direction for forming a light emitting cell array. When the display device is rotated together with the wheel, the light emitting cell array is scanned within a rotating trace of the wheel. With a combination of the rotary scanning by the light emitting cell array and time division illumination control for respective light emitting elements, an aerial image can be formed by the residual image effect on the rotatingly scanned surface.

In the shown construction, a position signal outputting means such as a magnet is mounted on a supporting plane such as a frame of the bicycle. On the other hand, the device body is provided with a signal generating means for generating a synchronization signal every time the device body moves across the closest position to the position signal outputting means. Namely, the synchronization signal is generated once during one cycle of rotation of the rotary body. Image display operation is initiated at a timing delayed from the occurrence of the synchronization signal for a predetermined delay period At. Also, a most recent average period of the synchronization signal which is inversely proportional to the rotation speed is constantly obtained. As a result, the image can be displayed at a predetermined rotational phase position even when the rotation speed fluctuates.

That is, in synchronism with rotational scan of the light emitting cell array, the image data of the image to be displayed is sequentially read out from a memory. Then, respective light emitting cells in the light emitting cell array are selectively illuminated according to the read out image data. Here, it is important to establish synchronization between rotation of the device and the display control so as to stably display the image.

In case of the display device in which the light emitting cell array is driven at a constant rotational speed by means of a motor or so forth, such as that illustrated in Japanese Unexamined Patent Publication No. 2-213892, the foregoing feedback type synchronization control may not be necessary. However, for the display device adapted to the rotary body which may irregularly fluctuate the rotation speed, it is inherent to provide certain synchronization control for stability of the displayed image.

On the other hand, a manually operated scan type aerial display device has been proposed in commonly owned European Patent First Publication No. 05 46 844, published on Jun. 16, 1993 (corresponding U.S. patent application which has now been pending under U.S. patent application Ser. No. 07/991,547, filed on Dec. 11, 1992). The disclosed swing or scan type aerial display system is adapted to aerially display a desired visual image utilizing a residual image effect of a moving light emitting cell array. In order to establish synchronization of the motion of said moving light emitting cell array and illuminating timing of individual cells in the light emitting cell array, the motion behavior of the system is monitored and timing to drive each individual cell is controlled in relation to the monitored motion behavior of the light emitting cell array, so that the desired image becomes visible at a desired position and desired configuration. The aerial display system includes a display control circuit having a memory for storing an image data corresponding to the image to be displayed. The display control circuit receives the output of a sensor monitoring the swing motion of the light emitting cell array for selectively illuminating the individual cells in synchronism with the swing motion to aerially display the desired image. More specifically, the display control circuit reads out an image data in a bit map format in a predetermined order per line to line at an appropriate speed for driving the individual cells to illuminate and obscure depending on the lighting pattern at respective lines in synchronism with the swing motion of the main body. Then, by the afterimage or residual image effect, aerial image can be displayed in the aerial space.

The above-identified commonly owned prior invention provides significant gain in manually operated scan type display as far as the display device is operated in reciprocal manner. In case of the rotary type display device, however, the prior proposed invention is not applicable as it is since such type of display device has no stroke end and a direction of acceleration does not vary periodically. This means that, in case of the rotary type display device, the synchronization mechanism which is successfully applied in the prior invention, is not fully effective.

SUMMARY OF THE INVENTION

Therefore, it is an object of the invention to provide a manually operated rotary scan type display device which can establish synchronization between rotational phase of the device and display control.

Another object of the present invention is to provide an aerial display device, which can stably display every line image data at fixed rotational phase and whereby stably display the image in the aerial space.

A further object of the invention is to provide a rotary type display device which assures smooth rotation of the display device for stability of the displayed image.

A still further object of the invention is to provide a rotary scan type display device which permits updating of the image data to be displayed arbitrarily.

A yet further object of the invention is to provide a rotary type aerial display device which has a bait-in image scanning function.

According to one aspect of the invention, a manually operated rotary type display device, according to the present invention, comprises:

a device body of an elongated bar-shaped configuration having a plurality of light emitting cells provided on the surface of the device body, the light emitting cells being arranged in alignment along a longitudinal direction of the device body to form a light emitting cell array;

an operation fulcrum member mounted on one end of the device body and rotatable about an axis perpendicular to the longitudinal direction of the device body;

a rotary marker secured to the operation fulcrum member for co-rotation therewith and having at least one mark;

rotation detecting means for obtaining a relative angular position information between the device body and the operation fulcrum member and rotation speed information, by detecting the at least one mark of the rotary marker;

storage means for storing an image data to be displayed by rotational scanning of the light emitting cell array; and display control means for reading out the image data sequentially from the storage means in synchronism with a detection signal by the rotation detecting means.

The device body may include an opening at the one end and the operation fulcrum member may comprise a ring member arranged to allow a human finger to engage therewith and extend therethrough. The ring member is rotatably engaged to an inner periphery of the opening. In the alternative, the operation fulcrum member may have a handle facilitating gripping by a human hand. The handle extends from the device body in the direction perpendicular to the surface thereof.

In one embodiment of the invention, the rotary marker is in a circular shape and has a plurality of the marks arranged at an equal pitch for separating one cycle of rotation of the rotary marker into a plurality of zones. Preferably, one of the marks is distinguished from the others and is used to detect each rotation of the rotary marker. The other marks are arranged to an angular interval of 10°.

The rotation detection means may comprise a photo-interrupter fixedly secured to the device body and facing the rotary marker.

In a preferred construction, the manually operated rotary type display device, according to the present invention, further comprises means for reading and updating an image to be displayed by the display device. The means may include:

optoelectric transducer cell array arranged in parallel to the light emitting cell array in the vicinity thereof for receiving a reflected light from an image source irradiated by a light beams from the light emitting cell;

first control means for synchronizing illumination control of the light emitting cell array and output reading control of the optoelectric transducer cells and for reading a linear image along the light emitting cell array and the optoelectric transducer cell array; and second control means for storing in the storage means the image data obtained in order from the optoelectric transducer cell array by repeatedly performing the first control means in synchronism with the detection signal from the rotation detection means, upon rotationally scanning the light emitting cell array and the optoelectric transducer elements over the image source about the operation fulcrum member.

BRIEF DESCRIPTION OF THE DRAWINGS

The present invention will be understood more fully from the detailed description given herebelow and from the accompanying drawings of the preferred embodiments of the invention, which, however, should not be taken to be limitative to the present invention, but are for explanation and understanding only.

In the drawings.

DESCRIPTION OF THE PREFERRED EMBODIMENT

The present invention will be discussed in detail in terms of preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order not to unnecessarily obscure the present invention.

Figure 1:
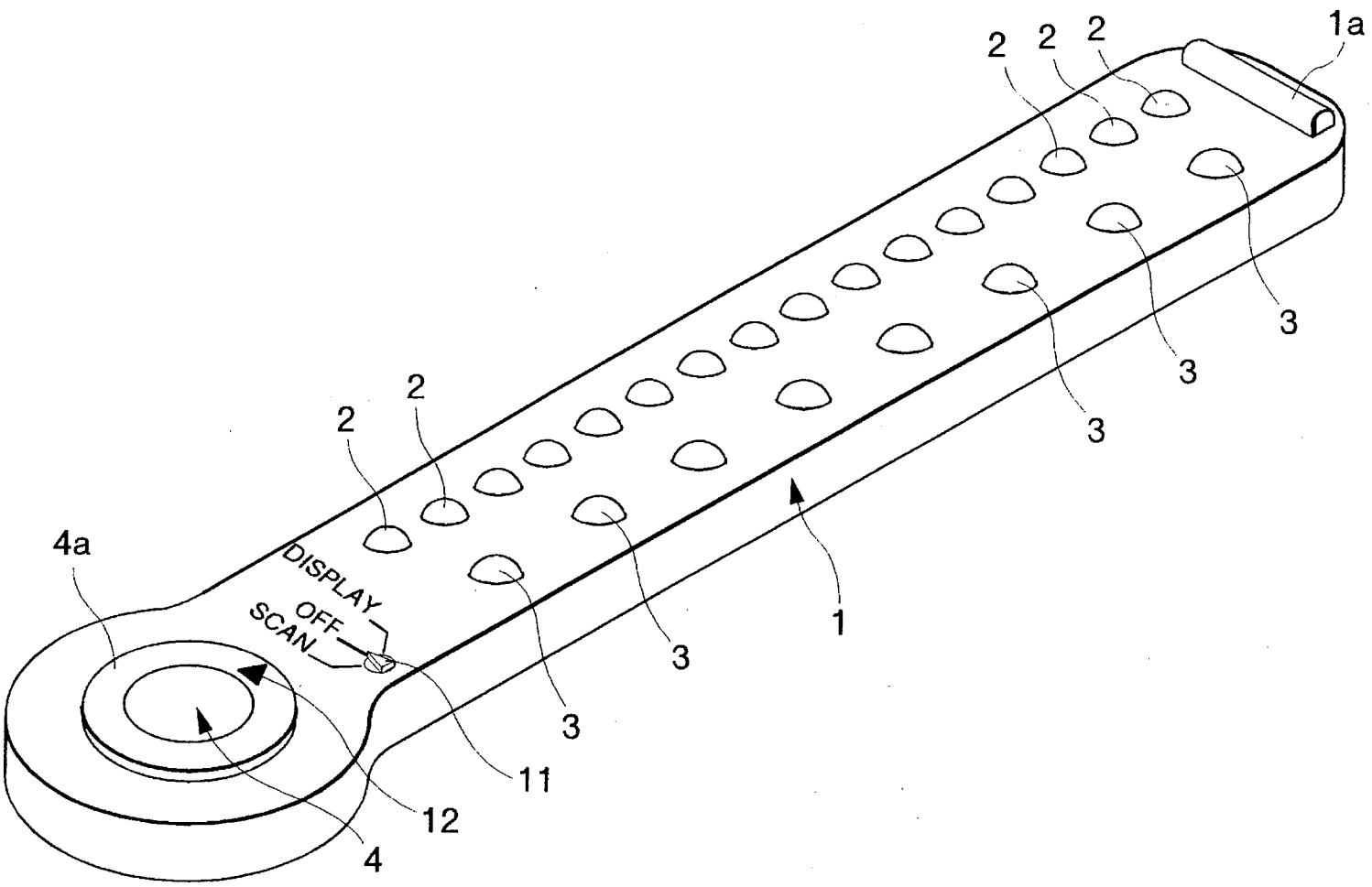
FIG. 1 is a perspective view showing general construction of one embodiment of a manually operated rotary scan type display device according to the present invention.

FIG. 1 shows the preferred embodiment of the manually operated rotary scan type display device of the present invention. As shown in FIG. 1, a main body 1 has a flat bar shape. A plurality of (sixteen in the shown embodiment) LED's 2 are arranged on the front surface of the main body 1 in a constant pitch in alignment to form a LED array. In parallel to the LED array, eight light receiving elements 3 are provided in alignment. The aligned LED array and the aligned array of the light receiving elements 3 are placed in a spaced apart positional relationship. In the practical construction, the light receiving element may comprise a phototransistor. Also, in the illustrated example, the pitch of arrangement of the light receiving elements 3 is set at double of the arrangement pitch of the LED's 2. Specifically, each light receiving element 3 is located adjacent to a pair of LED's 2.

As a fulcrum member for rotational operation in manual scanning of the display device, the main body 1 is provided with a rotary ring 4 at the base portion. The mounting structure of the rotary ring 4 is illustrated in detail in FIG. 2. As can be seen from FIG. 1, the base end portion of the main body or the device body 1 is formed into a ring-shaped configuration within which the rotary ring 4 is engaged. The rotary ring 4 has integrated flanges **4*a* and 4*b* at both ends. Respective of the flanges 4*a* and 4*b* mate with front side surface and back side surface of the ring-shaped base end of the main body 1. For assuring smooth rotation of the rotary ring 4 relative to the main body 1, a bearing mechanism is interposed between the rotary ring 4 and the inner periphery of the ring-shaped base end. In the illustrated construction, the bearing mechanism comprises a sliding member 5 formed of a low friction member, such as Teflon (tradename: N.V. Du Ponte) at mating portion between the rotary ring 4 and the main body 1**.

The internal diameter of the rotary ring 4 is designed to accommodate a human finger. When using this display device, a user inserts a finger through the rotary ring 4, and the finger is oriented substantially in horizontal direction. At this condition, the main body 1 is placed in the loosely hanged position. Then, by moving the finger in circular fashion, such that a circle is drawn by the tip of the finger, the main body 1 is driven to rotate about the finger inserted through the rotary ring 4. At this time, the rotary ring 4 is fixedly secured to the finger, and the main body 1 is rotated about the rotary ring 4. The rotary ring 4 allows the rotational movement of the main body 1, as set forth above.

Figure 2:
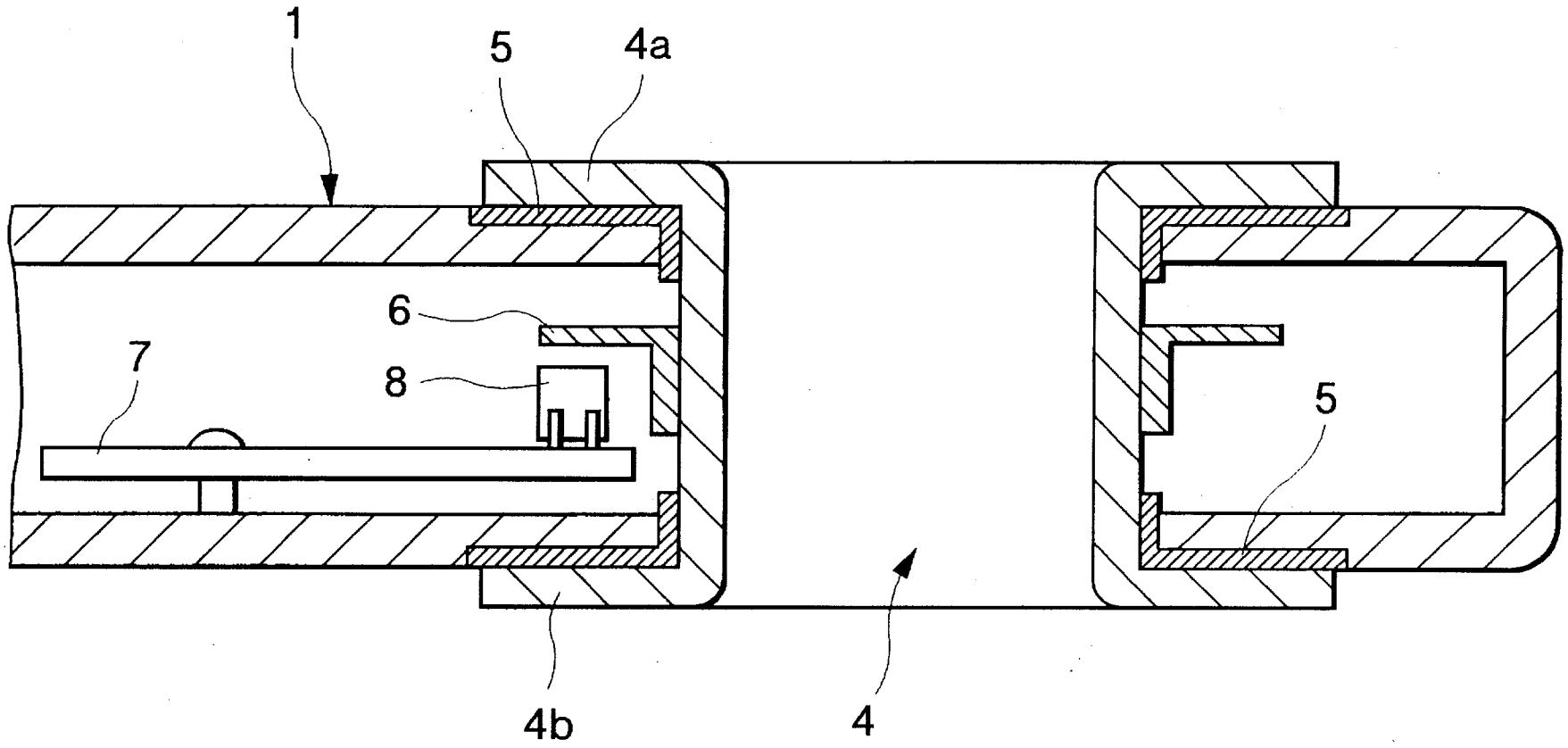
FIG. 2 is an enlarged section of a mounting portion for an operation fulcrum member in the first embodiment of the manually operated rotary scan type display device according to the present invention.
Figure 3:
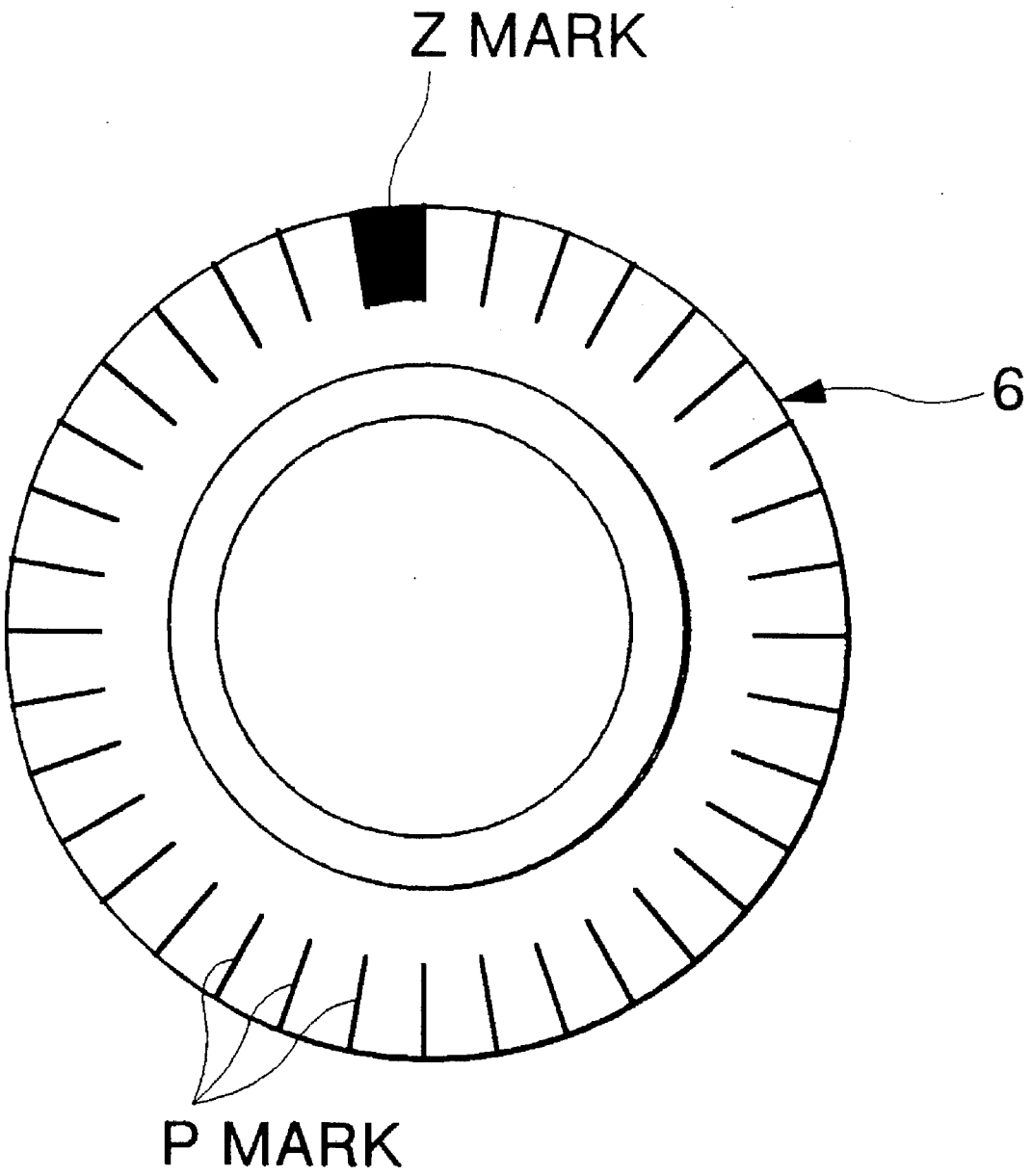
FIG. 3 is a front elevation of a rotation marker to be employed in the first embodiment of the manually operated rotary scan type display device.

In order to detect the relative angular displacement of the rotary ring 4 relative to the main body 1, a rotary sensor is provided as a rotation detecting means. As shown in FIG. 2, the rotary sensor includes a rotary marker plate 6 fixed onto the outer periphery of the cylindrical portion of the rotary ring 4 to extend into the hollow space of the main body 1. The rotary marker plate 6 carries a mark calibrated at every predetermined angle, e.g. 10°, and includes one zero angle point mark (Z mark) to be detected once per one cycle of rotation and calibration marks (P mark) at every 10°.

Figure 4:
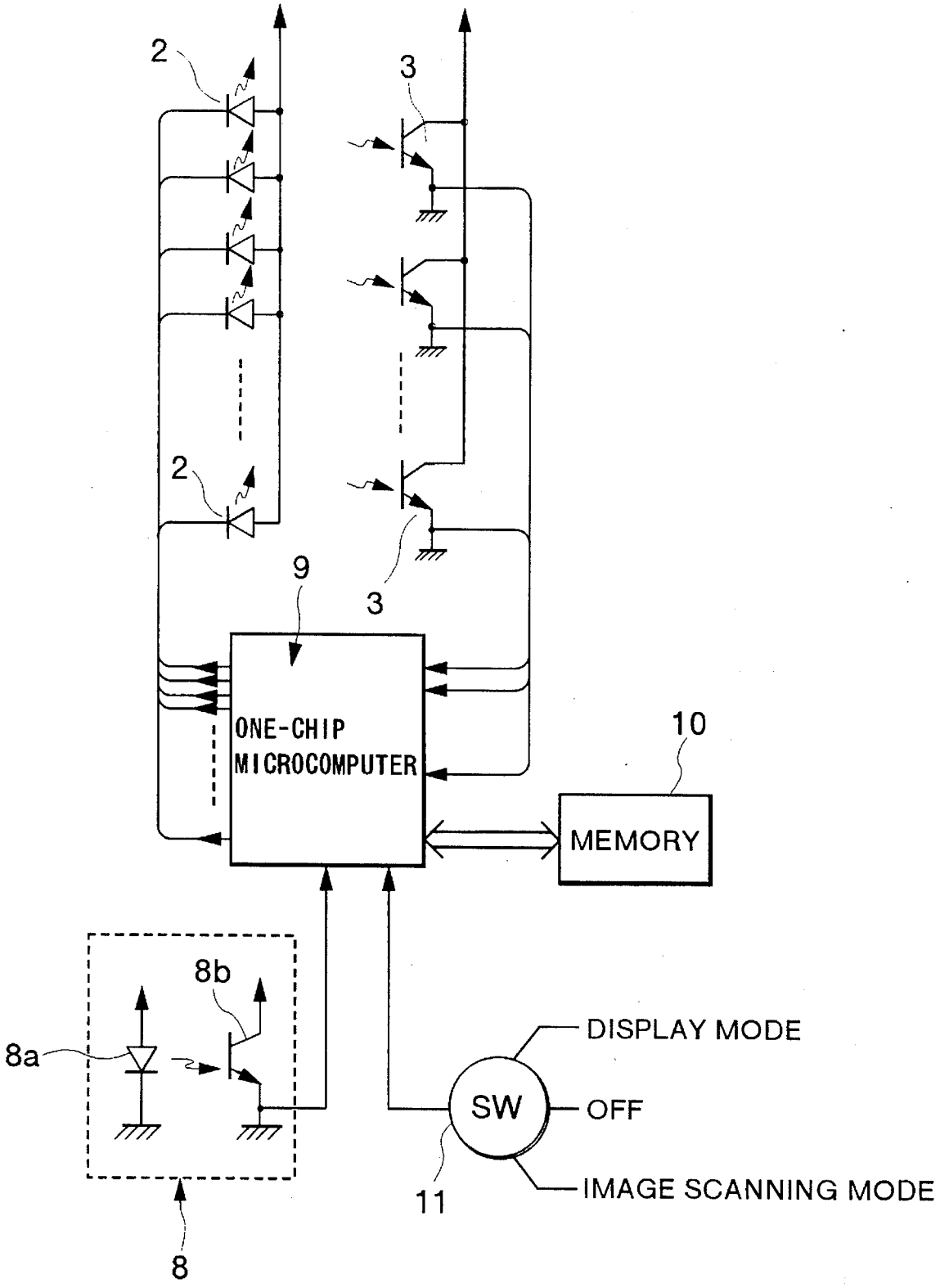
FIG. 4 is a circuit diagram showing an electrical construction in the first embodiment of the manually operated rotary scan type display device.

As shown in FIG. 2, a printed circuit board 7 installed with the LED array, the PT (photo-transistor) array and other circuits, is housed within the main body 1. Mounted on the edge of the circuit board 7 is a rotation sensor 8 comprising a photo-interrupter. As shown in FIG. 4, the rotation sensor 8 has a light emitting diode **8*a* and a photo-transistor 8*b*, which are arranged in opposition to the rotary marker plate 6 (see FIG. 2**) for optoelectrically detecting the marks.

Also, as shown in FIG. 4, control and signal processing of the device including selective illumination control for selectively driving the LED for selective illumination thereof, and reading control for reading the outputs of the PT array, are all done by the one-chip microcomputer 9. The display data is stored in a memory 10 in a form of bitmap and accessed by the microcomputer 9. The output signal of the rotary sensor 8, as the rotation detection signal according to rotation of the rotary marker plate 6, is input to the microcomputer 9. The rotation detection signal serves as a reference signal for the operation timing of the display device. A switch 11 serves as a power switch of the device, and also serves as a mode selector switch. Thus, the switch 11 outputs a signal indicative of the selected operational mode of the one-chip microcomputer 9. On the basis of the output signal of the switch 11 serving as the mode select signal, the operational mode of the display device is switched between the display mode and image scanning mode.

The display mode is an operational mode for rotating the display device in the aerial space to perform aerial image display by selectively illuminating the LED's 2 in the LED array. On the other hand, the image scanning mode is an operational mode for scanning or reading image from an image source, such as an original print paper or so forth, for sampling image data to be stored in the memory 10.

Figure 5:
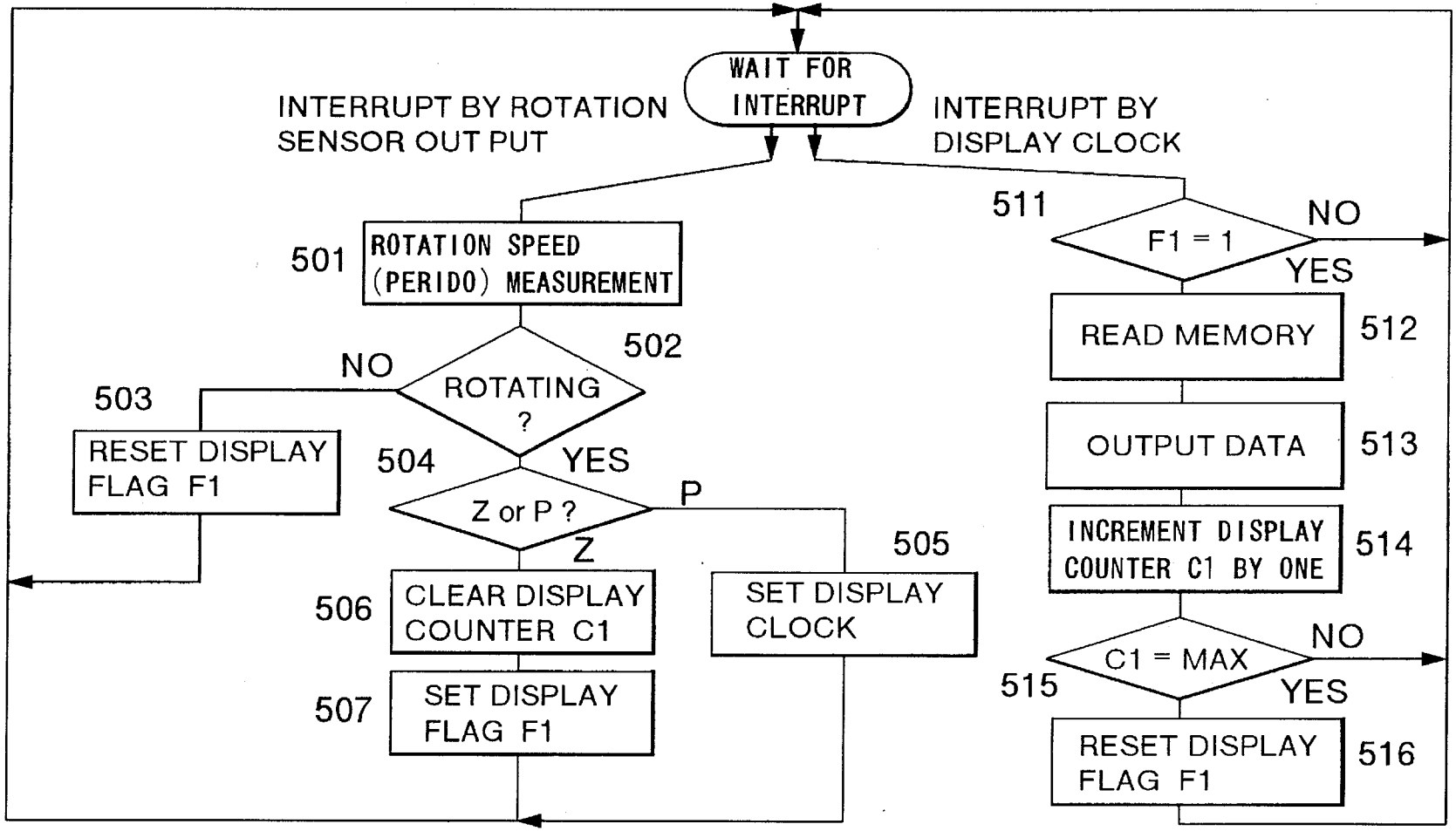
FIG. 5 is a flowchart showing a control process in a display mode to be implemented by the first embodiment of the manually operated rotary scan type display device.

FIG. 5 is a flowchart showing a process executed by the microcomputer 9 in the display mode. This process is branched into an interrupt process to be executed in response to the rotation detection signal from the rotation sensor 8 and an interrupt process to be executed in response to a display clock generated in a manner discussed later.

The microcomputer 9 performs rotation measurement process at a step 501 at every occurrence of output signal from the rotation sensor 8. In this process, the output signal of the rotation sensor 8 is discriminated whether it is a Z mark signal generated in response to detection of the Z mark or a P mark signal generated in response to detection of the P mark. Based on the result of discrimination, the microcomputer 9 performs measurement of an input period of the Z mark and an input period of the P mark. As set forth above, when the main body 1 is rotated by inserting the finger into the rotary ring 4, not only the P mark signal but also the Z mark signal are sequentially generated at relatively short period. For successfully and stably displaying the image in the aerial space by the residual image effect, it is required that the main body 1 rotates at a speed higher than a certain rotary speed criterion. The rotation state of the main body at a speed higher than the rotary speed criterion will be hereinafter referred to as "stable rotation state". At a step 502, on the basis of the result of measurement at the step 501, rotation state of the main body is checked whether the stable rotation state is established or not.

When the stable rotation state is judged at the step 502, check is performed, at a step 504, whether the most recently input signal is the Z mark signal or the P mark signal. When the most recently input signal is the P mark signal, the process is advanced to a step 505. At the step 505 a parameter (frequency dividing ratio) for determining a clock period of a variable frequency divider for generating a display clock, which will be discussed later, is set on the basis of an average period of given number of most recent P mark signals.

In the shown embodiment, when the most recent average period of the P mark signal is assumed as t1, the microcomputer 9 internally generates a display clock having a period of t¼. As set forth above, the P mark signal is generated at every 10° of angular displacement of the rotary marker plate 6 relative to the rotation sensor 8. For the period of the P mark signal corresponding to 10° of angular displacement of the rotary marker plate 6, four display pulses are generated.

On the other hand, when the most recently input signal is the Z mark signal, the process is advanced to a step 506. At the step 506, a display counter C1 is cleared to be zero. Then, at a step 507, a display flag F1 is set. It is to be noted here that, if judgement is made at the step 502 that the stable rotation state is not yet established, the display flag F1 is reset at a step 503.

Next, at every occurrence of the display clock generated as above, the process of a step 511 and subsequent steps are executed. At first, at the step 511, the status of the display flag F1 is checked. If the display flag F1 is not set, the process is terminated and the microcomputer 9 is placed into stand-up or waiting state for waiting for occurrence of interruption.

As set forth above, the display flag F1 is set when the stable rotation state is established and the first Z mark signal is input. Also, the display clock is generated at a period ¼ of the average period of the most recent given number of P mark signals. For enabling this, the microcomputer 9 may be provided with a shift register for storing the period data of the given number of most recent P mark signals, which is not shown in the drawings. Manner of latching the period data and shifting out the oldest period data at every occurrence of fresh P mark signal should be well known in the art and is not necessary to be discussed.

When the display flag is determined to be set at the step 511, the process steps 512, 513 and 514 are executed in order. At the step 512, the value of the display counter C1 is read out as an address data for accessing memory. Then, the address in the memory corresponding to the designated address indicated by the display counter value C1, is accessed to read out a fraction of the image data. In the shown embodiment, one display line is consisted of 16 bits. Therefore, at the step 512, the 16 bits of pixel data as the fraction of the image data is read out. While the read out 16 bits of pixel data may be applied to respective of corresponding LED's 2 as serial data, the shown embodiment handles the 16 bits pixel data as parallel data to be applied simultaneously to respective LED's 2 at the step 513. Then, the LED's in the LED array are selectively illuminated for displaying a linear image depending upon the corresponding pixel data. Namely, when the pixel data is applied, only LED's corresponding to the pixel data of logical high (1) are illuminated.

Thereafter, the display counter C1 is incremented by one to designate the next address to be accessed in response to next P marker signal. After the process at the step 514, check is performed whether the incremented display counter value C1 reaches a predetermined maximum value or not, at a step 515. If the display counter value is checked as reaching the predetermined maximum value at the step 515, the process is advanced to a step 516, in which the display flag F1 is reset. Then the device falls into stand-by state waiting for next occurrence of the P mark signal. Otherwise, the process directly falls into the stand-by state jumping the process at the step 516.

As can be appreciated, while the stable rotation state of the display device is maintained, all fractions of the image data are read out in one by one line basis and fed to the LED array for driving the latter to selectively illuminate at respective angular positions to form the full image. The display speed is determined by the display clock period, which display clock period is determined by the average period of the given number of the most recent P mark signals. Accordingly, as long as the rotational state is maintained within the range higher than the rotation speed criterion, the display output speed is varied in response to the rotation speed of the device. This means that the display position and size can be stable to form the desired image in the aerial space.

Also, at a timing where the Z mark signal is generated at every cycle of rotation, the display device is returned to the initial state to restart display mode operation. Therefore, in order to start image display at a desired rotational phase position, the initial angular position of the rotary marker plate 6 may be adjusted so that the Z mark signal is generated at a timing corresponding to such desired rotational phase position to start image display. For assisting adjustment of the position of the Z mark on the rotary marker plate 6, an orientation mark 12 is provided on the external surface of the flange of the rotary ring 4 as shown in FIG. 1. For instance, when the orientation mark 12 is directed vertically upward, the image display is initiated at the vertically upward position of the main body 1.

Next, image scanning mode will be discussed with reference to a flowchart in FIG. 6. This mode is adapted to scan or read the image drawn on an image containing medium, such as a printed paper or so forth, by an image scanner like operation of the LED array and the PT array so that the newly sampled image data is stored in the memory as image updating data.

The image containing medium, such as a paper, on which the desired image is presented by drafting, printing or so forth, is placed in opposition to the LED array and the PT array. At this time, since the flange **4*a* of the rotary ring 4 is projected from the front surface of the main body 1 and the main body is provided with a projection 1*a* at the tip end, an appropriate distance between the image containing surface of the medium and the LED and PT arrays, can be maintained. Then, each individual LED 2** is illuminated in order to locally irradiate the corresponding position on the medium.

Reading is performed by sequentially illuminating the LED's 2 in one-by-one basis. In the shown embodiment, since each light receiving element 3 is corresponded to two LED's 2, the output of the light receiving element 3 is read when the corresponding one of the LED's 2 is illuminated. Namely, when the first LED 2 is illuminated, the output of the corresponding first light receiving element 3 is read. Also, when the second LED 2 is illuminated, the output of the corresponding first light receiving element 3 is also read. However, when the third LED 2 is illuminated, the output of the second light receiving element 3 which corresponds to the third and fourth LED's is read. In the similar manner, subsequent LED's are illuminated in order and outputs of the corresponding light receiving elements are read. The linear image for one display line is thus sampled as sixteen dot image data.

For scanning two-dimensional image, the orientation mark 12 on the rotary ring 4 is directed in a scanning start line direction. Then, the rotary ring 4 is fixedly held in place by a finger. Thereafter, the main body 1 is rotated about the rotary ring 4 at relatively low speed within a desired angular range. At this time, the rotation detection signal is generated by the rotation sensor 8. The one-chip microcomputer 9 is operated in response to the rotation detection signal for performing sampling of the linear images at respective predetermined angular positions in synchronism with the rotation of the main body 1. Thus, bitmap format image data having respectively sixteen dot pixel data can be obtained.

Figure 6:
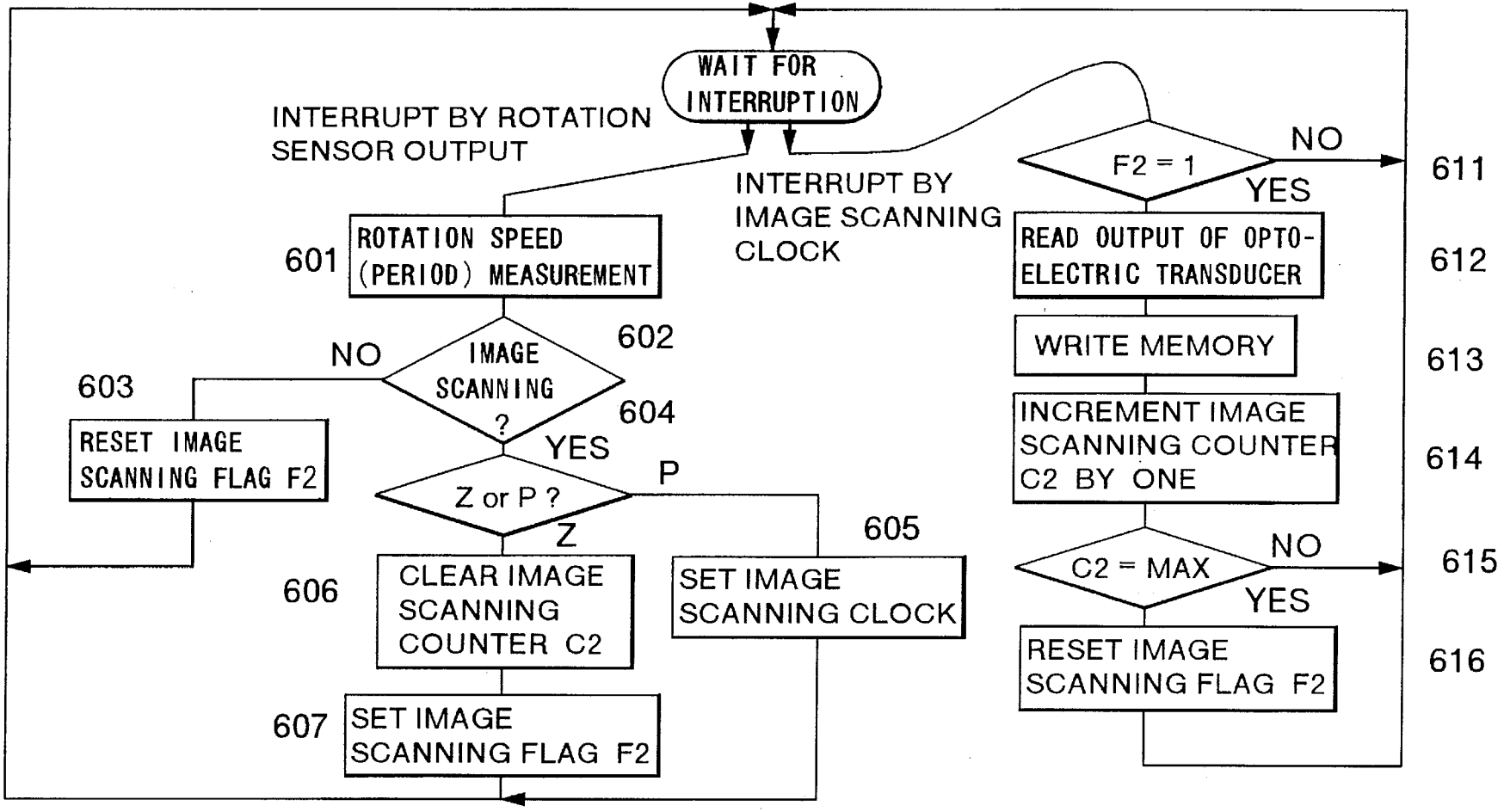
FIG. 6 is a flowchart showing a control process in an image scanning mode to be implemented by the first embodiment of the manually operated rotary scan type display device.

FIG. 6 shows a flowchart for reading or image scanning process to be performed in the image scanning mode operation. The shown process is initiated in response to a demand for interruption. In the illustrated case, the output of the rotation sensor 8 and the image scanning clock may serve as the interrupt demand. Depending upon kind of input signal, the process is branched. That is, when the input signal is the output signal of the rotation sensor 8, the process is advanced to a step 601, in which discrimination is made whether the input signal is the Z mark signal or the P mark signal. Based on the result of discrimination, period measurement for the Z mark signal or the P mark signal is performed at the step 601. The measured period is used at a step 602 to make a judgement as to whether the main body 1 is rotated within a predetermined low speed range. The rotational state where the main body 1 is determined to rotate stably at the predetermined low speed range will be hereinafter referred to as "stable image scanning state". When a judgement is made at the step 602 that the stable image scanning state is not yet established, an image scanning flag F2 is reset at a step 603, and the process returns to the stand-by state for waiting for next interruption demand.

On the other hand, when a judgement is made at the step 602 that the stable image scanning state is established, the process is advanced to a step 604. At the step 604, discrimination is made whether the most recently input signal is the Z mark signal or the P mark signal. When the input signal is determined to be the P mark signal, the process is advanced to a step 605, in which a parameter (frequency dividing ratio) for determining a clock period of a variable frequency divider for generating the image scanning clock is set on the basis of an average period of given number of most recent P mark signals. In the shown embodiment, similarly to the display clock, the image scanning clock is set at ¼ of the average period of the P mark signal.

In case a judgement is made at the step 604 that the input signal is the Z mark signal, it is recognized that the main body 1 has reached the image scanning start position. Then, the image scanning counter C2 is cleared to zero at a step 606. Subsequently, at a step 607, the image scanning flag F2 is set.

After setting of the image scanning flag F2 at the step 607, the processes of the steps 611 to 616 are executed at every occurrence of the image scanning clock to sample 16 bits pixel data for one display line (in the manner set forth above) at a step 612. Then, the sampled pixel data is written in the address of the memory 10 corresponding to the image scanning counter value C2 at a step 613. Thereafter, the image scanning counter C2 is incremented by 1 for designating next address, at a step 614. Subsequently, the incremented image scanning counter value C2 is checked at a step 615 if it becomes greater than or equal to a predetermined maximum value. When the image scanning counter value C2 is determined at the step 615 to be greater than or equal to the maximum value, the image scanning flag F2 is reset at the step 616. By this, one field of image data can be scanned from the image containing medium and stored in the memory 10.

Figure 7:
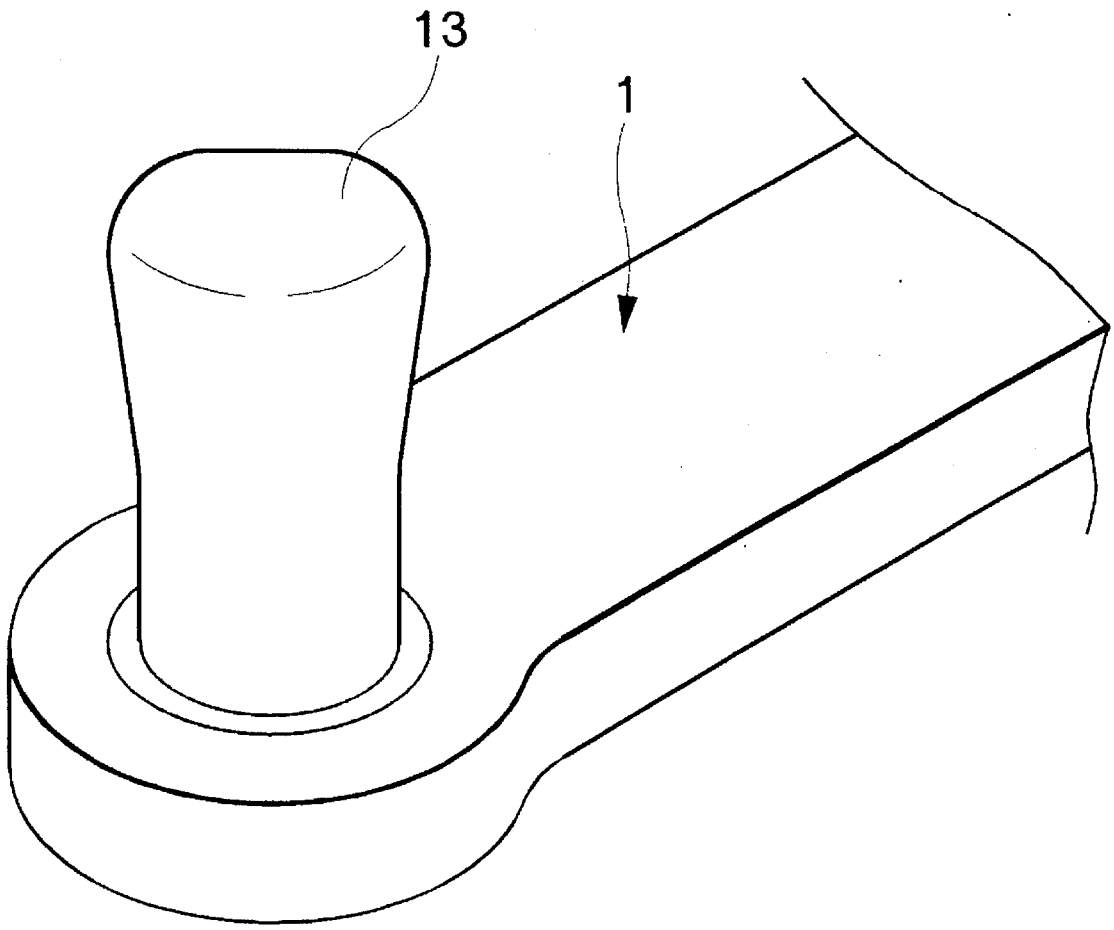
FIG. 7 is a perspective view of another embodiment of the operation fulcrum member to be employed in the manually operated rotary scan type display device according to the present invention.

FIG. 7 illustrates another example of a fulcrum member to replace with the rotary ring 4 in the above embodiment. It comprises a handle 13 to be gripped by hand for rotating the main body 1 thereabout. The handle 13 extends in a direction perpendicular to the axis of the main body 1 and is secured thereto in a rotatable manner. It is to be understood that the handle 13 has an end portion which is housed within the main body 1 and to which a member similar to the marker plate 6 of FIG. 2 is attached. In case the display device is relatively large and has a substantial weight, the handle 13 is considered preferable as compared with the rotary ring.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

For instance, while the shown embodiment employs the display device which has the image scanning function for sampling image data to update the content of the memory for permitting display of arbitrary image, image source should not be specified to the disclosed type of image scanning function. Rather, it may be possible that the image may be provided in a form of non-volatile storage medium, such as a memory card, floppy disk and so forth. In such case, the image scanning function may be omitted and, instead, an appropriate memory drive for reading image data from the storage medium and transfer to the microcomputer becomes necessary. It is also possible to provide the display device with an appropriate system to interface with an external image data source, such as a personal computer, wordprocessor and so forth for externally transferring the image data to the memory.

What is claimed is:

1. A manually operated rotary type display device comprising:

a device body of an elongated bar-shaped configuration having a plurality of light emitting cells provided on the surface of said device body, said light emitting cells being arranged in alignment along a longitudinal direction of said device body to form a light emitting cell array;

an operation fulcrum member mounted on one end of said device body and rotatable about an axis perpendicular to the longitudinal direction of said device body;

a rotary marker secured to said operation fulcrum member for co-rotation therewith and having at least one mark;

rotation detecting means for obtaining a relative angular position information between said device body and said operation fulcrum member and rotation speed information, by detecting said at least one mark of said rotary marker;

storage means for storing an image data to be displayed by scanning of said light emitting cell array; and display control means for reading out the image data sequentially from said storage means in synchronism with a detection signal by said rotation detecting means.

2. A manually operated rotary type display device as set in claim 1, wherein said device body includes an opening at said one end, and wherein said operation fulcrum member comprises a ring member adapted to allow a human finger to engage therewith and extend therethrough, said ring member being rotatably engaged to an inner periphery of said opening.

3. A manually operated rotary type display device as set forth in claim 1, wherein said operation fulcrum member has a handle portion facilitating gripping by a human hand, said handle portion extending from said device body in the direction perpendicular to the surface thereof.

4. A manually operated rotary type display device as set forth in claim 1, wherein said rotary marker is in a circular shape and has a plurality of said marks arranged at an equal pitch for separating one cycle of rotation of said rotary marker into a plurality of zones.

5. A manually operated rotary type display device as set forth in claim 4, wherein one of said marks is distinguished from the others and is used to detect each rotation of said rotary marker.

6. A manually operated rotary type display device as set forth in claim 5, wherein said other marks are arranged at an angular interval of 10°.

7. A manually operated rotary type display device as set forth in claim 1, wherein said rotation detecting means comprises a photo-interrupter fixedly secured to said device body and facing said rotary marker.

8. A manually operated rotary type display device as set forth in claim 1, further comprising means for reading and updating an image to be displayed by the display device.

9. A manually operated rotary type display device as set forth in claim 8, wherein said image reading and updating means includes:

an optoelectric transducer cell array arranged in thereof for receiving a reflected light from an image source parallel to said light emitting cell array in the vicinity irradiated by a light beam from said light emitting cell;

first control means for synchronizing illumination control of said light emitting cell array and output reading control of said optoelectric transducer cell array and for reading a linear image along said light emitting cell array and the optoelectric transducer cell array; and second control means for storing in said storage means the image data obtained in order from said optoelectric transducer cell array by repeatedly performing said first control means in synchronism with the detection signal from said rotation detecting means, upon rotationally scanning said light emitting cell array and said optoelectric cell array over the image source about said operation fulcrum member.

* * * * *